US006644527B1

(12) United States Patent
Karenga

(10) Patent No.: US 6,644,527 B1
(45) Date of Patent: Nov. 11, 2003

(54) STRAP PACK CARRIER

(76) Inventor: Tarik Saidi Karenga, 34238 Arizona St., Union City, CA (US) 94587

( * ) Notice: Subject to any disclaimer, the term of this patent is extended or adjusted under 35 U.S.C. 154(b) by 0 days.

(21) Appl. No.: 10/386,807

(22) Filed: Mar. 10, 2003

(65) Prior Publication Data

(65)

Related U.S. Application Data

(63) Continuation-in-part of application No. 10/222,402, filed on Aug. 15, 2002, which is a continuation-in-part of application No. 10/174,015, filed on Jun. 17, 2002.

(51) Int. Cl.[7] ..... A41D 29/00

(52) U.S. Cl. ..... 224/602; 2/1; 224/603; 224/606; 224/623; 224/647

(58) Field of Search ..... 224/602, 603, 224/606, 623, 626, 647, 931; 2/338, 1

(56) References Cited

U.S. PATENT DOCUMENTS

| | | | | | |
|---|---|---|---|---|---|
| 776,193 | A | * | 11/1904 | Mills | 224/602 |
| 1,110,694 | A | * | 9/1914 | Jennings | 224/603 |
| 1,128,149 | A | * | 2/1915 | Jennings | 224/602 |
| 1,683,427 | A | * | 9/1928 | Turner | 224/626 |
| 3,599,238 | A | * | 8/1971 | Matthews | 2/1 |
| 3,931,917 | A | * | 1/1976 | Zellmer | 224/602 |
| 4,319,704 | A | * | 3/1982 | Rosen | 224/270 |
| 4,480,775 | A | | 11/1984 | Stanford | |
| 4,634,031 | A | * | 1/1987 | Frankhouse | 224/603 |
| 4,722,464 | A | * | 2/1988 | Wright | 224/602 |
| 5,575,004 | A | * | 11/1996 | Eisele et al. | 2/1 |
| 5,718,364 | A | * | 2/1998 | McDowell | 224/603 |
| 5,873,506 | A | | 2/1999 | Golling | |
| 6,112,960 | A | | 9/2000 | Seering | |
| 6,209,769 | B1 | | 4/2001 | Seals | |
| 6,293,445 | B1 | | 9/2001 | Miller | |
| 6,308,345 | B1 | * | 10/2001 | Williams, Jr. | 2/468 |
| 6,345,751 | B1 | | 2/2002 | Elliot | |
| 6,478,509 | B2 | * | 11/2002 | Powley | 224/255 |
| 6,491,196 | B1 | * | 12/2002 | Coler | 224/602 |
| 2003/0006261 | A1 | | 1/2003 | Morrison | |

* cited by examiner

*Primary Examiner*—Gary E. Elkins
(74) *Attorney, Agent, or Firm*—Gary Baker

(57) ABSTRACT

The strap pack carriers of the invention can be worn as a sash. Strap pack personal article carriers, e.g., form a loop adapted to stably conform to the body of the wearer to provide easy access pouches up in front of the body. Counter weights can be mounted to help stabilize the carrier against unequal front to back loads of articles.

20 Claims, 3 Drawing Sheets

STRAP PACK CARRIER

CROSS-REFERENCE TO PRIOR APPLICATIONS

This is a continuation in part of U.S. patent application Ser. No. 10/222,402, now pending Strap Pack Carrier, by Tarik Saidi Karenga, filed Aug. 15, 2002, which is a continuation in part of U.S. patent application Ser. No. 10/174,015, Strap Pack Carrier, now pending by Tarik Saidi Karenga, filed Jun. 17, 2002, each of which is incorporated herein by reference in its entirety, the priority to and benefit of the filing date of which is hereby claimed under 35 USC §120.

References Cited

U.S. PATENT DOCUMENTS

Seals, et al. Apr. 3, 2001 U.S. Pat. No. 6,209,769

BACKGROUND OF THE INVENTION

1. Field of the Invention

The invention relates to personal article carrier devices. The carrier of the invention provides, e.g., a strap loop adapted to be worn as a sash with pouches in front for easy access and visibility by the user.

2. Description of Related Art

A wide range of carriers of personal articles exist which include a pouch with a strap. Common examples include hand bags, clutches, carry on bags, back packs, fanny packs, and side packs. Yet, none of the available carriers offers hands free convenient access to articles in a carrier that conforms neatly to the front of the wearer's body.

Hand bags are essentially a pouch with a strap. The user carries the hand bag with the strap in one hand. This is inconvenient for the user as the hand can tire and the hand holding the bag is not available for other functions, The bag is set down to open it and gain access. Once the owner sets the hand bag down, it might be left behind and lost.

Purses are large hand bags with a longer strap that can be placed over the shoulder. This frees up the hands to do other things and to search for articles in the purse. The purse is a weight on a loop of string and naturally stabilizes in a pendulum fashion, low at the side of the user, even if the strap is run over the head and diagonally across the chest. The purse can not be worn under clothing such as jackets. A purse can be lifted up front, and held by one hand, while it is searched and articles removed. Purses can be ripped from the shoulder of the owner and stolen by a "purse snatcher".

Back packs are designed with two shoulder straps to carry heavy loads high on the back. This carrier configuration suffers from poor access to articles. The back pack user must remove both straps and set the bag on a surface in order to search the contents.

Belt packs and "fanny packs" are worn low around the waist. The belt packs are an improvement over other personal carriers because they place the load on the hip skeletal structure so there is little fatigue and they can be worn up front for hands free viewing and removal of articles. Still, are less than elegant and too bulky to wear under a jacket.

All of these carrier inventions require straps systems, or depend on the weight of the pouch and articles, or a clumsy arrangement of straps, to hold the pouch in a stable orientation. Purses, for example, naturally dangle on the strap with the pouch section hanging at the lowest point. Single strap packs hang low in the back of the user. Such carriers tend to swing uncontrollably if the user experiences dynamic movements, such as occur during running. Many single strap carriers employ an accessory waist strap or belt to prevent such swinging.

For example, side packs are available that include a large pouch that hangs from a strap, or on a belt clip, low at the side of user. In U.S. Pat. No. 6,209,769, "Side Pack" to Seals, a pouch dangles from a shoulder down to the waist area on the same side. A brace arrangement can be provided from the other shoulder to stabilize the pouch. Alternately the pouch can be mounted to the wearer's belt with a clip. The side pack pouch is complex and bulky. The pouch is low and to the side where the user must twist the body and reach unnaturally to remove a personal article.

A need remains for a personal article carrier device that provides comfortable hands-free carrying of personal affects up front in the chest area. It is desirable to have a sleek carrier that does not require accessory straps to prevent swinging while the user is walking. The present invention solves these problems, as will be made evident in the disclosure that follows.

SUMMARY OF THE INVENTION

The strap pack personal articles carrier of the invention is, e.g., a slim strap forming a loop of material that fits the contours of a wearer, from one shoulder to the opposite hip, to provide a comfortable stable platform for pouches. The pouches can be, e.g., located along the front of the strap so that personal articles are readily accessible and visible to the wearer. The stable configuration of the strap on the wearer's body can support the weight of the articles without the pouches swinging or slipping down. The strap can be further stabilized, for support of a large cumulative weight of articles, e.g., by providing counter weights mounted to the strap.

The strap pack carrier of the invention includes a strap forming a loop with a front section and a back section. The loop front section can have one or more pouches. The carrier can be worn by a person as a sash with the front section of the strap oriented forward so that pouches are visible and accessible with a natural motion of the arms and hands. One or more of the pouches can be, e.g., mounted at locations high on the front section of the strap on at the chest or abdomen of the person wearing the strap pack carrier.

The strap pack carrier can have counter weights mounted, e.g., at locations on the strap suitable to stabilize the carrier as being used and worn by a person. For example, when the carrier is worn with more than about 0.25 pounds of personal articles in pouches in the front section of the strap, a counter weight of about 0.25 pounds can be mounted in the loop back section of the strap. The counter weights can be mounted by locating them, e.g., within pouches in the front or back section of the strap, as appropriate. The counter weights can be mounted to the strap by, e.g., running the strap through one or more perforations in the weight. Typically, the counter weights of the invention can weigh from about 0.2 pounds to about 1 pound, or about 0.5 pounds. Counter weights of the invention can be fabricated, e.g., from compact materials of high density, such as iron, steel, lead, zinc, copper, gold, silver, tin and/or the like.

The strap pack carrier of the invention has an angle of intersection between the lower front section and back section that can be, e.g., from about 40 degrees to about 100 degrees. This lower intersection angle can be measured with the front section and back section laid out flat on a surface.

The angle can be measured from the continuation of the tangential lines from the edges of the sections even if the actual lower intersection has a rounded profile. In one embodiment, the strap pack carrier of the invention can have a lower angle of intersection between about 60 degrees and about 80 degrees as measured with the sections laid out flat. The strap pack carrier of the invention can favorably have a lower angle of intersection of about 70 degrees as measured with the sections laid out flat.

The strap pack carrier invention can have a strap length adjustment mechanism, e.g., in or between the loop sections to enable the wearer to change the size of the strap pack. This can allow the strap pack to comfortably and functionally be worn by persons of various sizes.

The strap pack carrier can be fabricated, e.g., from material about 5 inches wide, or less, as measured across a strap section, to provide pouches for wide personal articles, such as palm computers or wallets. The strap packs can be made, e.g., about 3 inches wide, or less, to snuggly carry narrower articles. Pouches can be adapted to carry a variety of personal articles such as, wallets, credit cards, business cards, cell phones, pocket computers, pens, belt clips, pagers, portable radios, CD players, eyeglasses, and the like. The pouches can have closure flaps and/or be removable from the strap. The pouches of the invention can also be located, e.g., on the back section of the strap. The pouches of the invention can also be located, e.g., on the lower intersection of the loop front section and loop back section.

The strap pack carrier can have the strap and/or pouches fabricated from, e.g., nylon, leather, Mylar®, canvas, plastic, Velcro® (e.g., fabric sided with resilient hooks that cling to fabric sided with loops) neoprene, wool, and the like.

The strap pack can be stabilized against swinging, slippage and rotation by, e.g., the way the contours of the strap fit the contours of the wearer's body. Frictional material, such as rubber, can be affixed, e.g., to the inner upper intersection or the inner lower intersection of the loop to help prevent shifting, rotation or slippage of the strap pack on the wearer (person wearing the carrier). An attachment means can be fixed to the loop to attach the strap to a garment worn under the strap pack to help prevent the strap from slipping. A rigid or semi-rigid curved cladding can be formed into the inner upper intersection to fix over the shoulder or the inner lower intersection of the loop to fit over the hip of the wearer to help hold the strap in place. Padding material can be affixed to an inner upper intersection or an inner lower intersection of the strap to increase the comfort of the wearer.

A wire mounting means can be included to route wires between the pouches and the wearer's head. This provides a neat appearance and prevents entanglement of the wires while the wearer moves about.

BRIEF DESCRIPTION OF THE DRAWINGS

The invention will now be more particularly described in connection with its preferred embodiments and with reference to the accompanying drawings wherein.

DETAILED DESCRIPTION OF THE INVENTION

Figure 1:
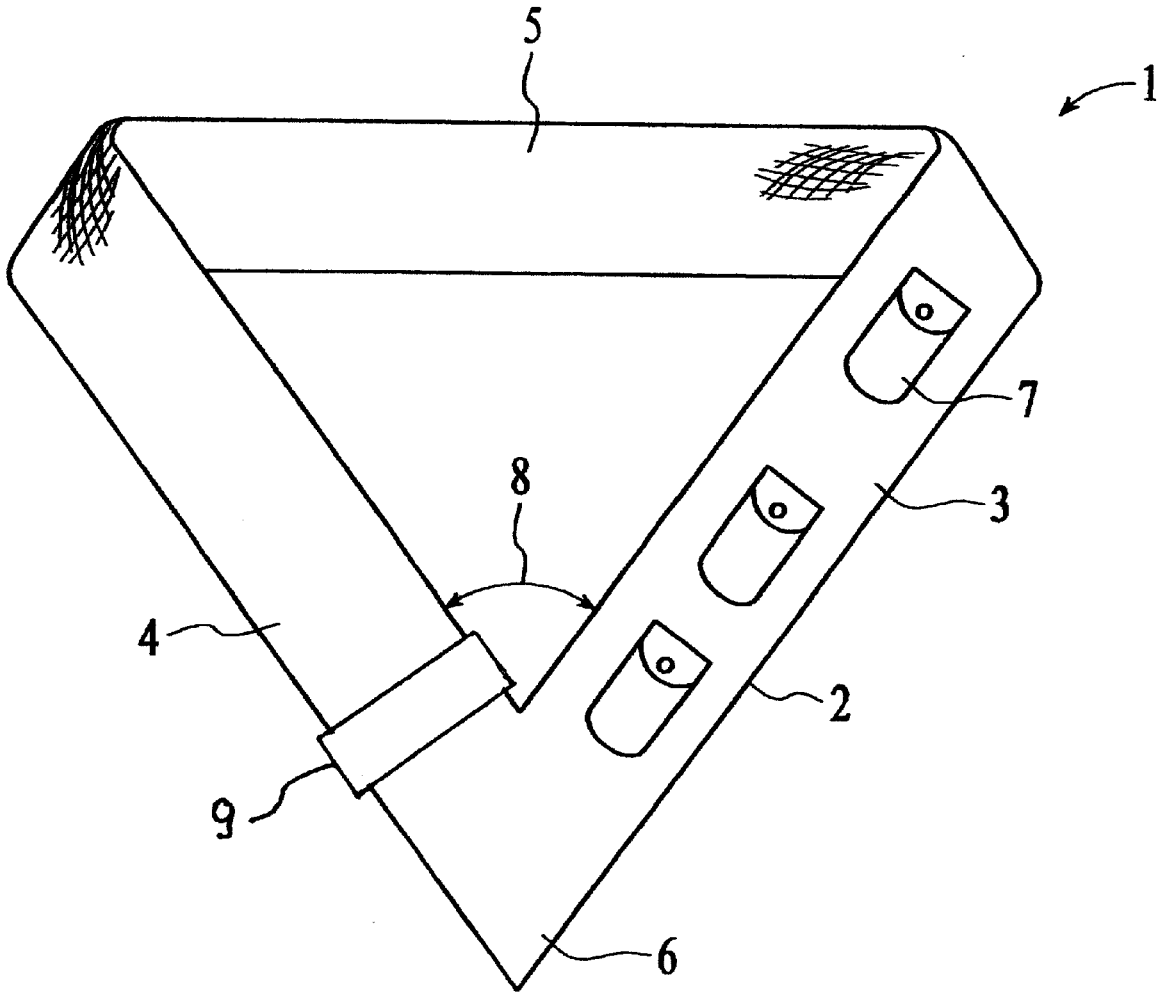
FIG. 1 is a schematic diagram of an exemplary strap pack laid out flat.

The strap pack personal article carrier of the invention can be, e.g., a narrow strap-like loop to be worn as a sash with front-facing pockets. The strap pack carrier loop has, e.g., a lower intersection, that if laid out flat, forms an angle less than 100 degrees. The topography of the strap pack carrier is, e.g., such that it conforms to the shoulders and torso of the wearer in a stable orientation that supports the weight of personal articles in the pockets. Counter weights can be mounted, e.g., to or between the front or back sections of the strap to balance and stabilize the strap against heavy loads of personal articles.

For example (see, FIG. 1), strap pack carrier 1 can be made up of strap 2 which forms a loop. The strap can include front section 3 and back section 4 that come together at upper intersection 5 and lower intersection 6. Pouches 7 can be located, e.g., on front section 3. Angle 8, of the lower intersection between front section 3 and back section 4, can provide, e.g., a strap configuration that conforms stably to the body of a person when worn as a sash. Counter weight 9 can be, e.g., perforated to allow mounting by running the strap through the counter weight.

The Strap

The main structural element of the invention is the strap. The strap is, e.g., a loop on material that can be worn by a person diagonally from a shoulder, across the chest and back, and over to the opposite waist or hip (i.e., in the fashion of a sash). The strap can generally be, e.g., a low aspect ratio (width to length), roughly conical (when laid out on its edge), ribbon with edges having different lengths. The strap of the invention has, e.g., topographic aspects that conform to the body surfaces of the wearer in a manner that provides comfort and stability of positional orientation.

The strap includes a front section and a back section that intersect at the top (shoulder area, as worn) and the bottom (hip/waist area, as worn). The positional stability of the strap, as worn, is provided by, e.g., the way the contour defined by the angles of intersection of the front and back sections match the contour of the wearer's shoulder, and waist or hip. The intersections, e.g., will not slip easily past the matching contours of the shoulder and/or hip/waist. The stability of the strap worn by a person is such that, e.g., pockets and personal articles can be mounted on the front section of the strap and the weight of the articles will not cause the strap to shift out of functional position, wherein the pouches are presented in the front of the user's body.

The intersections of the strap loop of the invention can be formed of continuous material, or by combining individual sections into a unit. The strap sections can be formed from, e.g., ribbons, straps, strips, or long rectangles of fabric, having two ends. The strap sections can be, e.g., attached together at the ends, by sewing, gluing, riveting, melting, etc., to form intersections. Those skilled in the art can also appreciate various ways the strap and intersections of the invention can be formed from continuous materials without having to, e.g., sew together segments to form the strap.

The basic contours of the strap of the invention can be provided, e.g., by controlling the angles at the intersections of the front and back strap sections. The lower intersection of the front and back sections can have an angle, e.g., between about 40 degrees and about 100 degrees. Larger angles can better fit the body contours as worn, e.g., by large, stocky, or obese persons. Smaller angles can better fit the body contours as worn, e.g., by small, thin, or petite persons. The lower intersection of the strap of the invention can, e.g., favorably conform to the contours of many wearers with an intersection angle of from about 60 degrees to about 80 degrees, as measured with the strap sections laid out flat. A strap of the invention with a lower intersection angle of about 70 degrees, as measured with the strap sections laid out flat, can be functionally be worn by most persons.

The upper intersection of the front and back sections can have an angle, e.g., between about 180 degrees and about 120 degrees, as measured with the strap laid out flat on a surface. This angle can adapt the strap well to the shoulder of the wearer.

Figure 2:
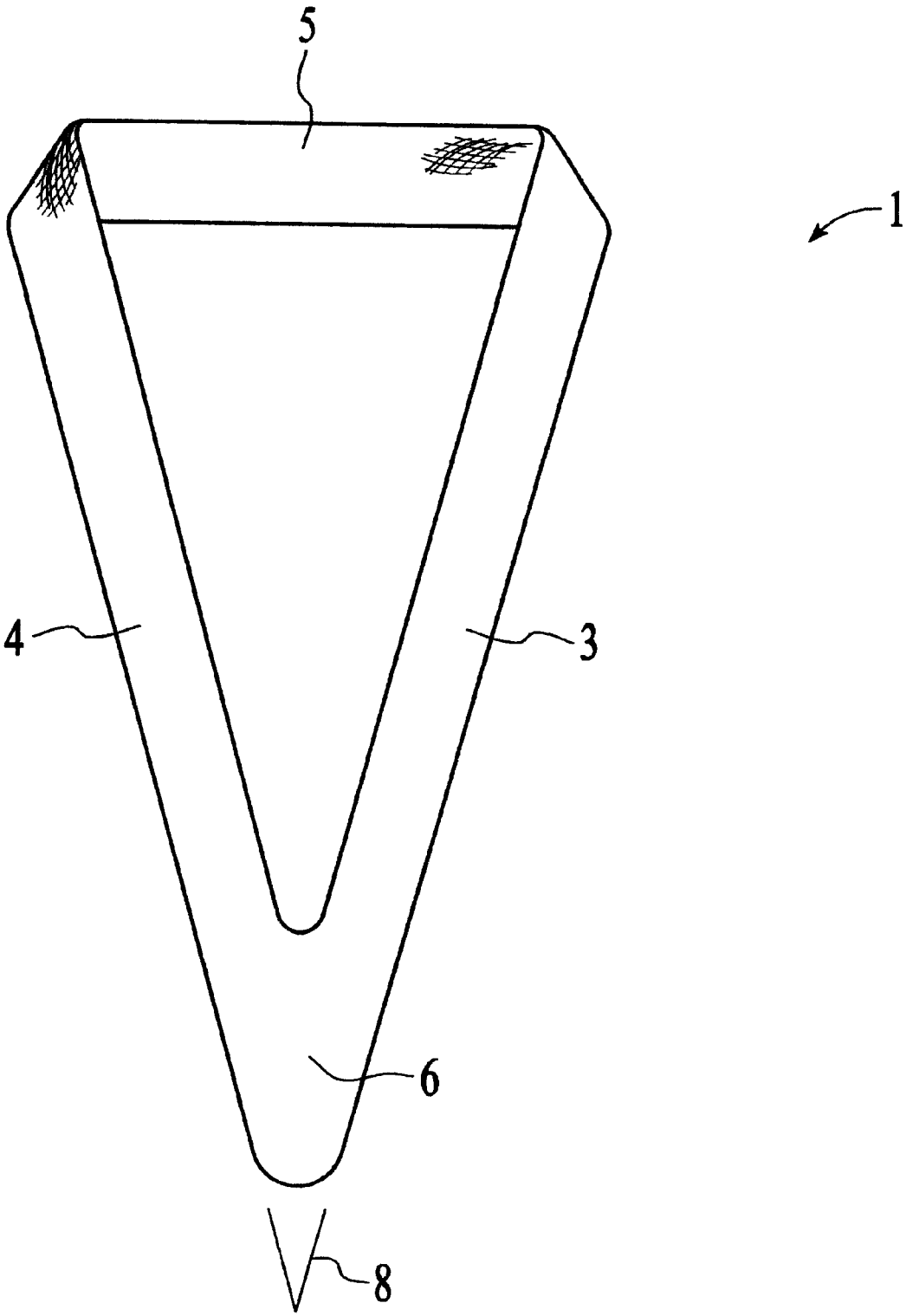
FIG. 2 is a schematic diagram of an exemplary strap pack with rounded contours at the lower intersection.

It can be appreciated by those in the art, from the disclosure herein, that the intersections can, e.g., be of a chevron style (as shown in FIG. 1), or have a rounded appearance (as shown in FIG. 2), while retaining the function of conforming to the body of the wearer and stabilizing the strap pack. Measurement of angle 8, as described above can be based, e.g., on the intersection of lines defined by continuation of the tangents to the edges of the sections above the actual intersection.

The circumference to the strap can, e.g., be any distance suitable to provide comfortable and stable fit to persons of any particular size. For example the strap circumference can be any sash size known in the art. A strap length adjustment mechanism can, e.g., be incorporated to enable changing the circumference of the strap loop. Adjustment of strap length can be useful, for instance, so the strap can be worn by persons of different size, so the strap can be worn over bulky or thin clothing, so a strap can be adjusted as a person grows, etc. The strap length adjustment mechanism can be, e.g., any appropriate type known in the art, such as a Velcro® system, buckle, snap, cinch, tie string, clip, and the like. The loop length adjustment can be located anywhere along the circumference of the strap loop, e.g., on the back section, or intersections, where it will not interfere with pouches, frictional materials, etc.

The strap of the invention can be, e.g., fabricated from durable, flexible materials such as fabrics and/or polymers. The main body of the strap is, e.g., a structural member that provides a stable platform for the location of pouches. The strap of the invention can be, e.g., fabricated from nylon, leather, Mylar®, canvas, plastic, neoprene, wool, and/or the like.

The strap of the invention can, e.g., provide a wire mounting means to route one or more wire between, e.g., electronic devices in pouches and the head of the wearer. For example, a wire running from a radio to an audio head-set, worn by the wearer of the strap pack, can be mounted along the strap to prevent snagging as the wearer moves about. The wire can be mounted, e.g., through a series of loops, through a conduit, inside a slit or flap in the strap material, and the like. The mounting means can be designed with, e.g., snaps, clips, tippers, Velcro®, laces, and the like to allow fast and convenient mounting and removal of wires.

Positional stability of the strap can be enhanced, e.g., by affixing a frictional material on the inside aspect of the upper and/or lower intersection of the strap sections. The frictional material can be any known in the art, such as rubber, soft textured plastic, or silicone compositions. Frictional contact of the upper intersection with the shoulder of the wearer and/or frictional contact of the lower intersection with the waist/hip of the wearer can thereby increase the positional stability of the strap.

Positional stability of the strap can be enhanced, e.g., by affixing rigid or semi-rigid curved cladding to match and retain the body contours, described above, on the inside aspect of the upper and/or lower intersection of the strap sections. Contours maintained by rigid or semi-rigid materials at the intersections increase the stability of the strap against slipping.

Positional stability of the strap can be enhanced, e.g., by affixing an attachment means to the strap to attach the strap to a garment, such as a shirt, worn by the person under the strap. The attachment means can include, e.g., a button system, a Velcro® system, a metal pin, a zipper, a snap system, a spring loaded clip, and the like. Such attachment means can be employed at one or more position about the strap, such as at the upper intersection of the front and back sections.

Positional stability of the strap can be enhanced, e.g., by providing one or more counter weights mounted to the strap. The counter weights can, e.g., balance the weight of personal articles carried in pouches of the strap. The counter weights can be mounted, e.g., to substantially equalize the total weight of the front section and any front-carried articles with the total weight of the back section and any back-carried articles. For example, when the cumulative weight of personal articles carried in the strap loop front section is more than a few ounces, a counter weight can be mounted in the strap loop back section to balance the front to back weight and stabilize the carrier position on the wearer. The counter weight can be mounted to the strap in any way appreciated by those skilled in the art, such as, e.g., by placing the weight in a pouch of the invention, by running the strap through one or more perforations in the counter weight, by the use of fittings (such as, buttons, zippers, Velcro, clips, pins, snaps, and/or the like). The counter weights can be permanently mounted or removable. For many combinations of carrier and articles, suitable counter weights can have a weight, e.g., from about 0.2 pounds to about 1 pound, or about 0.5 pounds. The use of dense materials can be preferred for the fabrication of counter weights in conformation with the typically slim and elegant character of the carrier. Counter weights of the invention can favorably be fabricated from materials containing, e.g., iron, steel, lead, zinc, copper, gold, silver, tin, and/or the like.

The comfort of the wearer of a strap pack carrier can be, e.g., enhanced by providing a padding material at the upper intersection where it rests on the shoulder. Padding material can be affixed inside the inner aspect of the upper intersection. Padding materials can include, e.g., foam rubber, cotton padding, bubbled plastic, air bladders, silicone gels, and the like.

The Pouches

The strap pack personal article carrier of the invention can have, e.g., one or more pouches located along the strap. The pouches can have, e.g., dimensions are well adapted to receive and hold a particular personal article. The pouches can be located, e.g., wherever it is convenient to carry and access a particular personal article. The pouches can, e.g., be mounted onto and/or integrated into the strap according to factors such as manufacturing efficiency and user preferences.

Pouches of the invention can be of sizes, e.g., adapted to receive a variety of personal articles. For example, the pouches can be of dimensions suitable to receive articles, such as a wallet, credit cards, business cards, cell phones, a pocket computer, pens, belt clips, pagers, eyeglasses, and the like. As the strap pack can be generally a slim device, the pouches can be, e.g., about five inches wide, three inches wide, or less. The pouches of the invention can, e.g., have a short to a quite long aspect ratio (length to width). A single pouch can, e.g., extend across substantially the entire length of the front loop section to hold long objects. Alternately a single pouch can be shallow, e.g., to receive belt clip mounts, matches, business cards, coins, and the like.

Pouches of the invention can be located anywhere along the internal or external surface of the front and/or back sections of the strap. In one aspect of the invention, one or more pouches are located on the external surface (as worn) of the front section of the strap. Pouches located at the mid to upper front section can, e.g., be convenient for the wearer to reach with her hands, and easy for the wearer to see. The unique stabilizing contours of the strap and/or mounted counter weights of the invention allow, e.g., significant weight loads in front pouches without slippage of the strap. Pouches can be located, e.g., on the internal surface of the strap, e.g., to provide secrecy and reduced exposure to the elements. Pouches can be located, e.g., on the back section to carry personal articles not requiring the most convenient access to the wearer. Pouches, articles and/or counter weights on the back section can, e.g., add to the stability of the strap by acting to balance the pouches and articles on the front section. Pouches can be located, e.g., in or on the lower intersection of the loop front section and loop back section to carry bulky or heavy assemblages of personal articles. Pouches on the lower intersection of the loop front section and loop back section can, e.g., add to the stability of the strap by acting as a stabilizing weight to pouches and articles on the front section.

Pouches can be, e.g., integrated into the strap or pouches can protrude from the strap. A pouch can be, e.g., a simple slit providing access to a space between layers of fabric material integral to a strap section. In one embodiment, a pouch can be, e.g., a box-shaped pocket mounted onto the external surface to a strap section. In another embodiment, a pouch can be, e.g., a removable sack attachable to the strap with Velcro® or clips known in the art. In another embodiment, a slit through the front layer of material in a strap can form a pouch to receive a cell phone belt clip so that the user can mount the phone near her face to speak on the phone "hands free."

Pouches of the invention can be, e.g., designed to efficiently accommodate common personal articles. For example, a pouch can be designed with dimensions to receive popular cell phones or pocket computers with a snug fit that accommodates protrusions; such as antennas. A cell phone or pocket computer pouch can be removable and have windows for viewing LC or LED displays.

Wearing the Strap Pack

Figure 3:
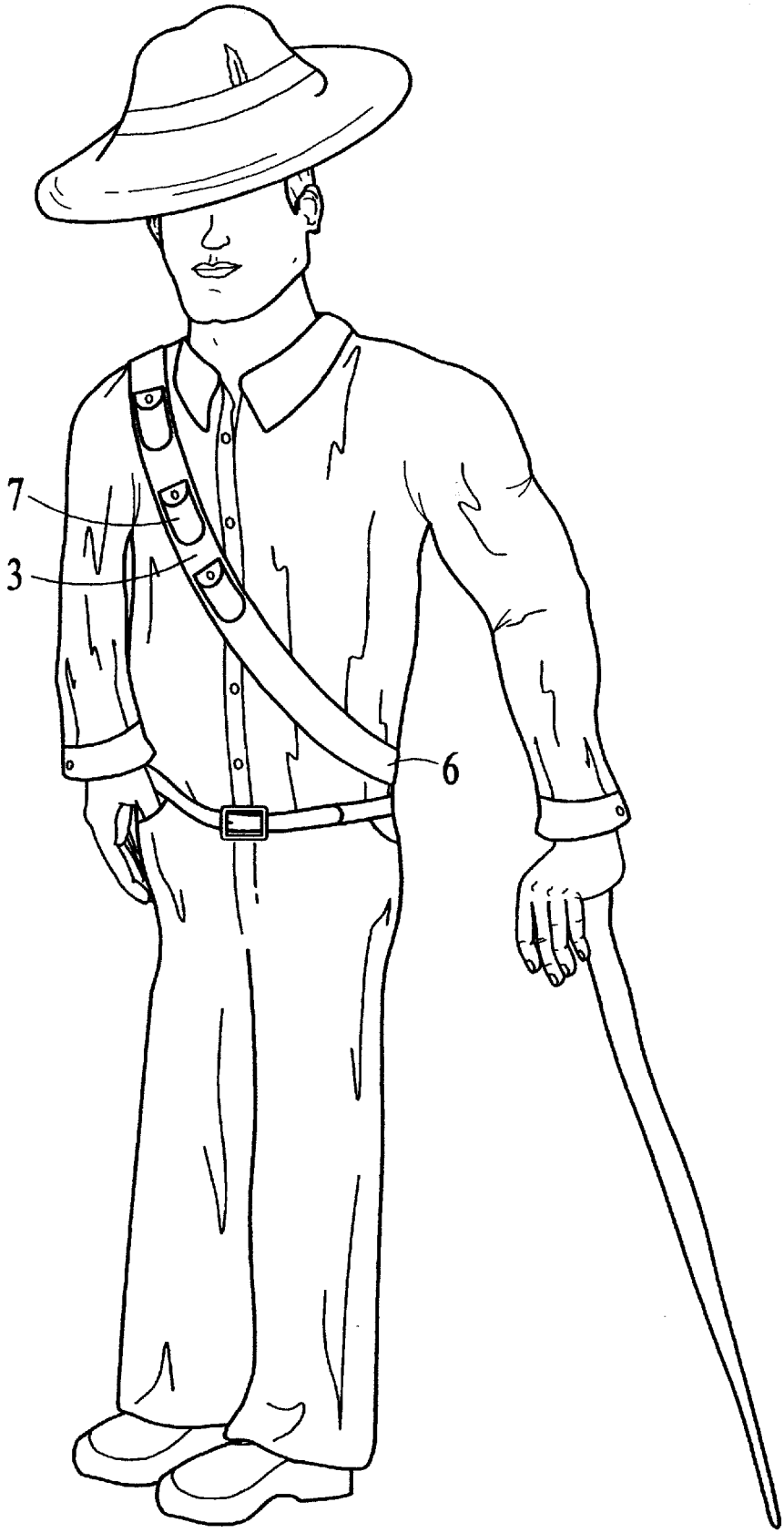
FIG. 3 is a schematic diagram of how a strap pack can be worn as a sash.

The strap pack of the invention can be worn, e.g., as a sash. For example, the strap pack can be placed over the head and one arm of the wearer so that the upper intersection comes to rest on a shoulder of the wearer and the lower intersection comes to rest on the opposite waist or hip of the wearer (see, FIG. 3). The sash orientation, e.g., running diagonally across the chest and back of the wearer, from the shoulder to the hip, provides a comfortable and stable way to carry personal articles.

The strap pack can be designed to be worn, e.g., either from the left shoulder to the right hip, or from the right shoulder to the left hip. In either case, pouches can be located on the front section for easy access by the wearer. Should a wearer, e.g., choose to wear a strap pack designed to rest on the left shoulder on her right shoulder, front pouches can functionally become back pouches, and visa versa. This may be, e.g., desirable to the wearer, and generally would not significantly reduce the stability of the strap pack; although accessibility to some pouches by the wearer can be reduced.

A strap pack can be designed, e.g., to be bilaterally symmetrical, as viewed along an axis from the upper to lower intersection. In such a case, the strap can, e.g., be stably worn with the upper intersection on the left or the right shoulder; the front and back sections trading places on the wearer depending on which shoulder the upper intersection rests on. A strap pack, designed to be worn on either shoulder can, e.g., have pouches, and/or pouch mounts, on both front and back sections so that convenient pouches can be provided in the front of the wearer no matter which shoulder the wearer chooses to place the upper intersection.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference in their entirety for all purposes.

What is claimed is:

1. A carrier comprising:

a strap comprising a loop front section and a loop back section;

the front section comprising one or more pouches; and, one or more counter weights mounted to the strap;

wherein the carrier is worn by a person as a sash.

2. The carrier of claim 1, further comprising a lower intersection of the loop front section and loop back section, wherein the lower intersection comprises an angle between about 40 degrees and about 100 degrees as measured with the sections laid out flat.

3. The carrier of claim 2, wherein the lower intersection comprises an angle between about 60 degrees and about 80 degrees as measured with the sections laid out flat.

4. The carrier of claim 2, wherein the lower intersection comprises an angle of about 70 degrees as measured with the sections laid out flat.

5. The carrier of claim 1 further comprising an upper intersection of the loop front section and loop back section, wherein the upper intersection comprises an angle between about 180 degrees and about 120 degrees as measured with the sections laid out flat.

6. The carrier of claim 1, further comprising a strap length adjustment in the strap, whereby the circumference of the strap can be changed.

7. The carrier of claim 1, wherein the strap or the pouches comprise a width of about 5 inches or less.

8. The carrier of claim 1, wherein one or more of the pouches are mounted at locations high on the front section of the loop when worn by the person.

9. The carrier of claim 1, wherein the one or more of the pouches are adapted to hold articles selected from the group consisting of a wallet, a credit card, a business card, a cell phone, a pocket computer, a pen, a belt clip, a pager, a radio, a CD player, and eyeglasses.

10. The carrier of claim 1, wherein the strap is fabricated from materials selected from the group consisting of nylon, leather, Mylar, Velcro, canvas, plastic, neoprene, and wool.

11. The carrier of claim 1, wherein the carrier is worn with the front section oriented forward.

12. The carrier of claim 1, further comprising one or more pouches located on the back section.

13. The carrier of claim 1, wherein the one or more counter weights are mounted to the loop back section.

14. The carrier of claim 1, wherein the one or more counter weights are mounted in a pouch or with the strap running through a perforation in the counter weight.

15. The carrier of claim 1, wherein the counter weights comprise a weight from about 0.2 pounds to about 1 pound.

16. The carrier of claim 15, wherein the counter weights comprise a weight of about 0.5 pounds.

17. The carrier of claim 1, wherein the counter weights comprise iron, steel, lead, zinc, copper, gold, silver, or tin.

18. The carrier of claim 1, further comprising one or more pouches located on a lower intersection of the loop front section and loop back section.

19. The carrier of claim 1, further comprising a padding material affixed to an inner upper intersection of the loop front section and loop back section.

20. The carrier of claim 1, further comprising a wire mounting means to route wires between the pouches and a head area of the person.

* * * * *